US006050858A

United States Patent [19]

Liu et al.

[11] Patent Number: 6,050,858

[45] Date of Patent: Apr. 18, 2000

[54] ELECTRICAL CONNECTOR WITH IMPROVED ELECTRICAL CONTACTS

[75] Inventors: Jia-Hung Liu, Hsin-Chuang; Jerry Wu, Chang-Hua Hsien, both of Taiwan

[73] Assignee: Hon Hai Precision Ind. Co., Ltd., Taipei Hsien, Taiwan

[21] Appl. No.: 09/104,889

[22] Filed: Jun. 25, 1998

[51] Int. Cl.[7] ..... H01R 24/00

[52] U.S. Cl. ..... 439/660

[58] Field of Search ..... 439/660, 682, 439/862, 495, 31, 65

[56] References Cited

U.S. PATENT DOCUMENTS 5,004,434 4/1991 Aiello et al. ..... 439/636
5,551,883 9/1996 Davis ..... 439/65
5,711,690 1/1998 Thrush et al. ..... 439/862
5,775,938 7/1998 Noro et al. ..... 439/495

*Primary Examiner*—Michael L. Gellner
*Assistant Examiner*—Barry M.L. Standig

[57] ABSTRACT

An electrical connector having a number of electrical contact in which a contact portion of each contact extends diagonally forward to engage a received, mating contact. Each electrical contact has a first leg anchored in an insulative housing of the connector and a substantially free second leg flush with a wall of a cavity formed in the connector. The contact portion of the electrical contact has an angled end consisting of a narrow neck and a large sector, the large sector gradually enlarging toward a free end thereof. The substantially free second leg of the electrical contact is spring biased against the wall of the cavity only upon insertion of a mating contact into the cavity to achieve a smooth insertion of the mating contact into the cavity.

1 Claim, 7 Drawing Sheets

ELECTRICAL CONNECTOR WITH IMPROVED ELECTRICAL CONTACTS

BACKGROUND OF THE INVENTION

The present invention relates to an electrical connector that is accessible along two intersecting sides for receiving electrical contacts of a mating electrical connector and more particularly to an electrical connector incorporating improved electrical contacts.

U.S. Pat. No. 5,551,883 issued to Davis on Sep. 3, 1996 discloses an electrical connector having an insulative housing, at least one contact receiving cavity defined in the housing and an electrical contact received in each cavity. The contact receiving cavity has a first cavity portion for receiving the contact and a second cavity portion for receiving a mating contact of a mating connector. A first channel, which has a stepped width defining a groove and a shoulder, is formed along a top edge of the first cavity portion. The electrical contact is of unitary construction, stamped and formed from a strip or blank of thin metal and has a thickness plane defined by the blank. A contact portion of the electrical contact extends either forwardly or diagonally from a front edge thereof and provides a cantilevered resilient spring. The contact portion has a tip which remains within the first channel behind the shoulder and is protected from being struck by the mating contact to be received in the second cavity portion. The tip of the contact portion remains within the first channel behind the shoulder which enables the tip to be resiliently deflected by a surface within the cavity to apply a spring bias, called a preload, to the contact portion. In addition, barbs are formed on both top and bottom edges of the contact for being anchored in the insulating housing.

According to the design of Davis '883 patent, since both top and bottom edges of the contact are stationarily anchored in the housing, an engaging force applied by the contact portion to the mating contact exists from the moment the mating contact begins to engage with the contact portion. This will create an immediate resistance to the mating contact such that a user must exert an abrupt increase of force during insertion of the mating contact. Similarly, an abrupt change in the engaging force may also occur during withdrawal of the mating contact.

The present invention aims to provide an improved electrical connector which permits a smooth insertion of a mating contact.

BRIEF SUMMARY OF THE INVENTION

One object of the present invention is to provide an electrical connector having an insulative housing, at least one contact receiving cavity in the housing, and an electrical contact received in a first cavity portion of the cavity, the contact having a contact portion extending diagonally forward into a second cavity portion of the cavity to engage with a mating contact received in the second cavity portion, wherein the improvement comprises: the electrical contact having a first leg anchored to the first cavity portion of the housing and a substantially free second leg flush with a wall of the first cavity portion; the contact portion of the electrical contact having an angled end consisting of a narrow neck and a large sector, the large sector gradually enlarging toward a free end thereof; and the substantially free second leg of the electrical contact being spring biased against the wall of the first cavity portion only upon insertion of a mating contact into the second cavity portion. With this construction, a smooth insertion of the mating contact into the second cavity portion can be obtained.

DETAILED DESCRIPTION OF THE INVENTION

Figure 1:
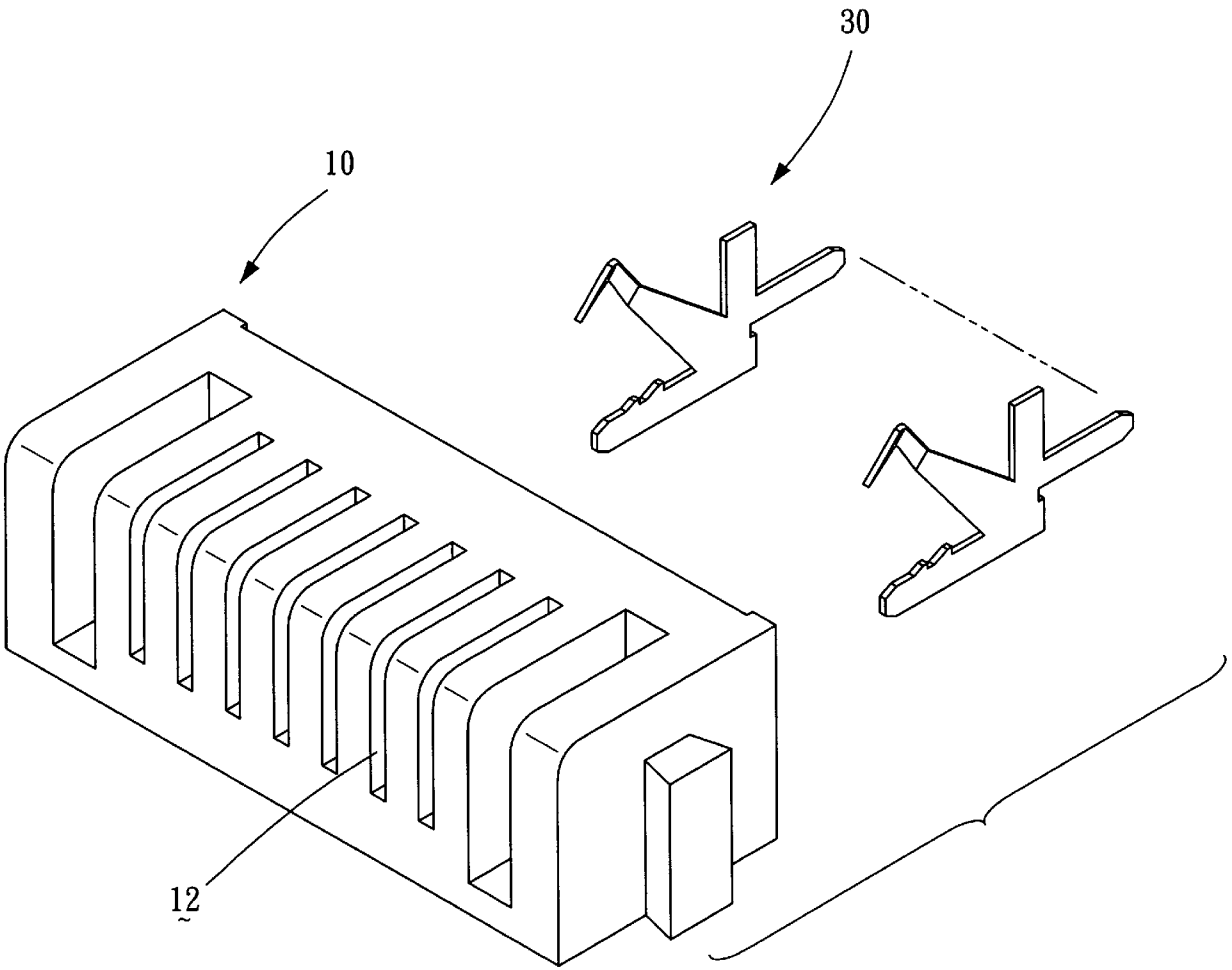
FIG. 1 is a front and top perspective view of an electrical connector incorporating electrical contacts constructed in accordance with the present invention.
Figure 7:
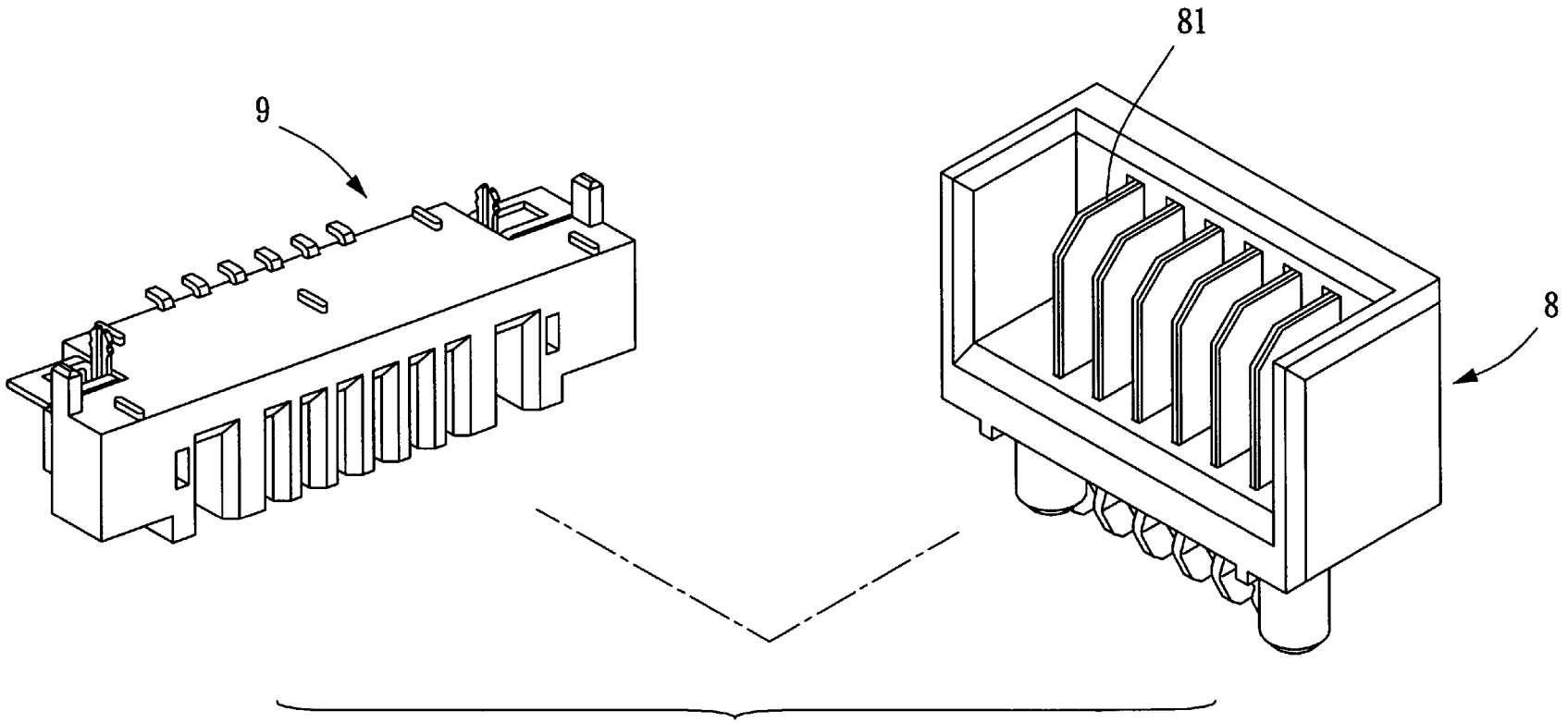
FIG. 7 PRIOR ART
FIG. 7 shows an electrical connector and a mating connector according to a prior art design.

FIG. 7 is substantially a reproduction of FIG. 1 of U.S. Pat. No. 5,551,883 in which an electrical connector 9 and a mating connector 8 are depicted. This prior art patent is incorporated herein by reference to a general description of the engaging relationship between the electrical connector 9 and the mating connector 8 and their application.

Figure 3:
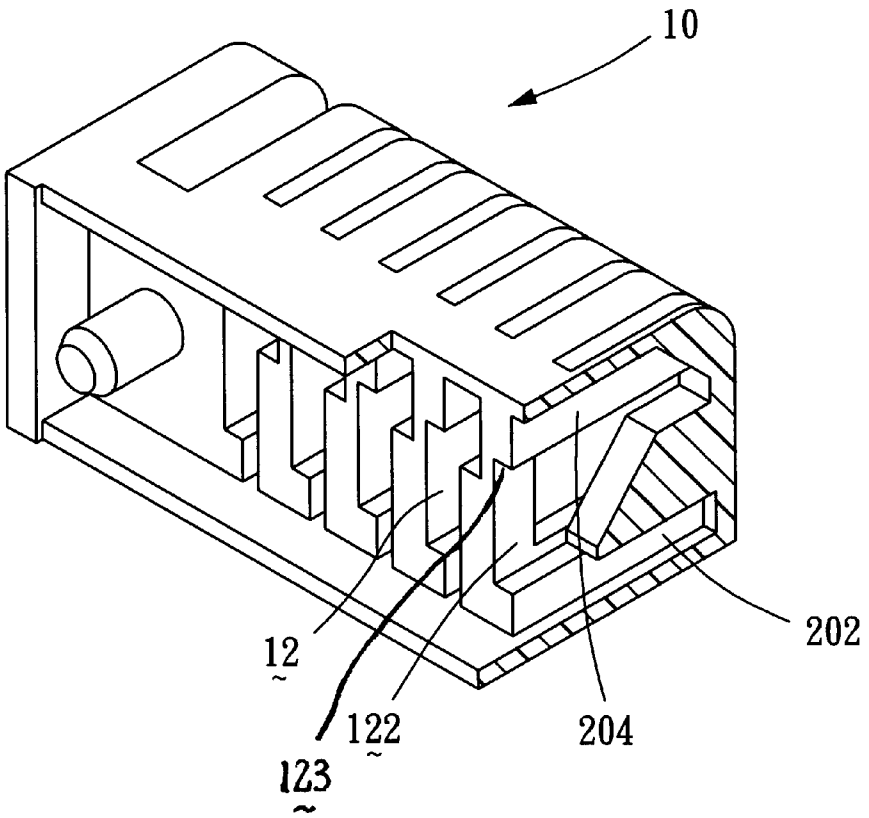
FIG. 3 is a fragmentary rear perspective view showing detail of an insulative housing of the connector of FIG. 1.

Referring to FIG. 1, the electrical connector of the present invention comprises an insulative housing 10 and a plurality of electrical contacts 30 fixedly mounted in the housing 10. The housing 10 has a plurality of contact receiving cavities 12 each receiving a contact 30 therein. FIG. 1 shows a front perspective view of the cavities 12, namely a first cavity portion, while FIGS. 3–5 each show a rear perspective view of the cavities 12, namely a second cavity portion. Detail of the first and second cavity portions will be described later.

Figure 2:
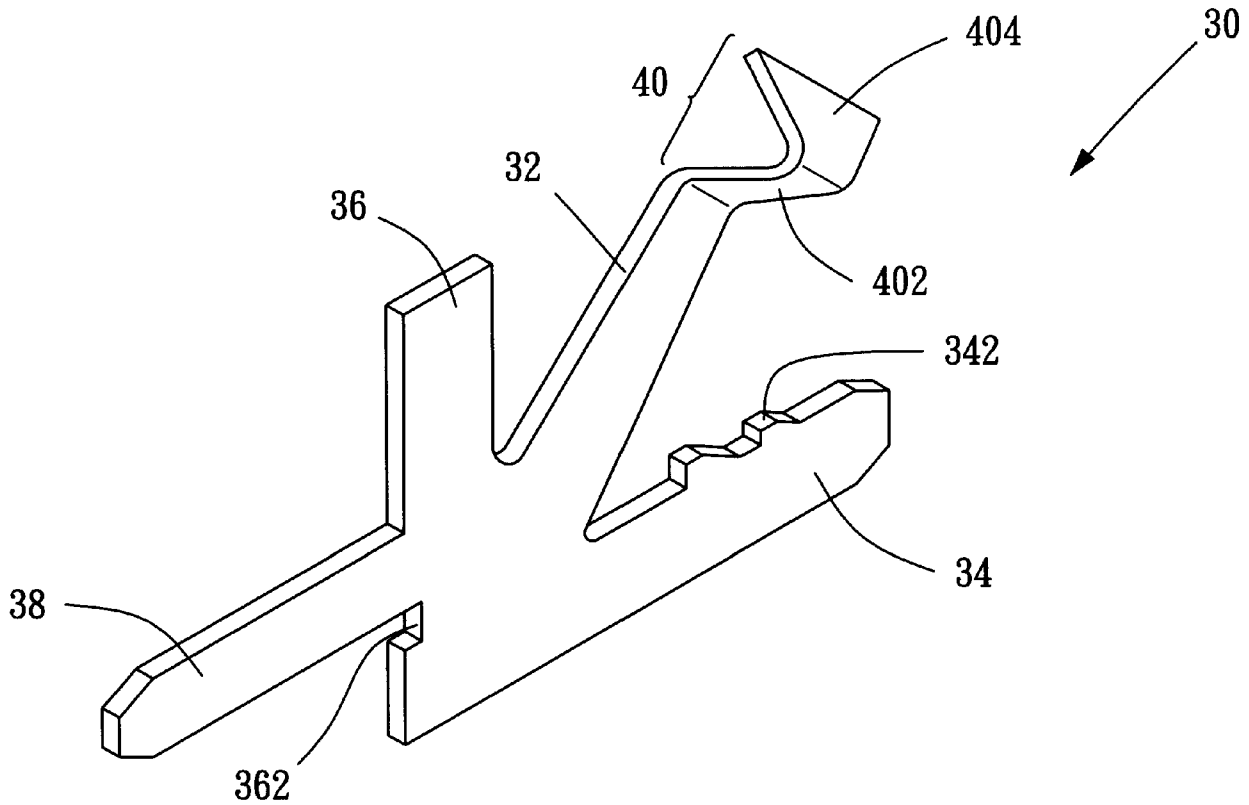
FIG. 2 is a perspective view of the electrical contact of FIG. 1.

FIG. 2 shows details of the contact 30. The contact 30 is of unitary construction, stamped and formed from a strip or blank of thin metal and has a thickness plane defined by the blank. The contact 30 has a contact portion 32 extending diagonally forward, a first leg 34 to be anchored in the housing 10 and a substantially free second leg 36. The first and second legs 34, 36 are arranged on opposite sides of the contact portion 32 with the first leg 34 being substantially horizontal and the second leg 36 being substantially vertical. The contact portion 32 extends approximately forty-five degrees, along a diagonal forward line, between the first and second legs 34, 36. Barbs 342 are provided on the first leg 34. A recess 362 is formed in a rear portion of the contact 30 below a suitably shaped terminal 38 to provide the second leg 36 with a desired resilient property with respect to the first leg 34. The contact portion 32 of the electrical contact 30 has an angled end 40. The angled end 40 consists of a narrow neck 402 and a large sector 404. The large sector 404 gradually enlarges toward a free end thereof.

Reference will now be made to FIGS. 3 through 6 where various partly cut-away, cross-sections can be seen in order to clearly show the contour of the cavity 12 and the engaging relationship between the cavity 12 and the contact 30. As mentioned previously, the cavity 12 comprises a first cavity portion 122 and an accommodation recess 123 (cf. FIG. 3), and a second cavity portion 124 (cf. FIG. 4). The first cavity portion 122 defines a channel 202 and a wall 204. The channel 202 receives the first leg 34 of the contact 30 with the barbs 342 anchored therein. The wall 204 is flush with the second leg 36 so that the leg 36 is freely movable in a direction away from the wall 204 while abutting against the wall 204 in a direction toward the wall 204. The leg 36 will only firmly abut against the wall 204 upon insertion of a mating contact 81 (cf. FIG. 7) into the second cavity portion 124. Under this circumstance, the substantially free second leg 36 of the electrical contact 30 is spring biased against the wall 204 of the first cavity portion 122. At the same time, the accommodation recess 123 beside the leg 36 may provide space for allowing lateral deflection of the contact portion 32 of the contact 30.

Figure 4:
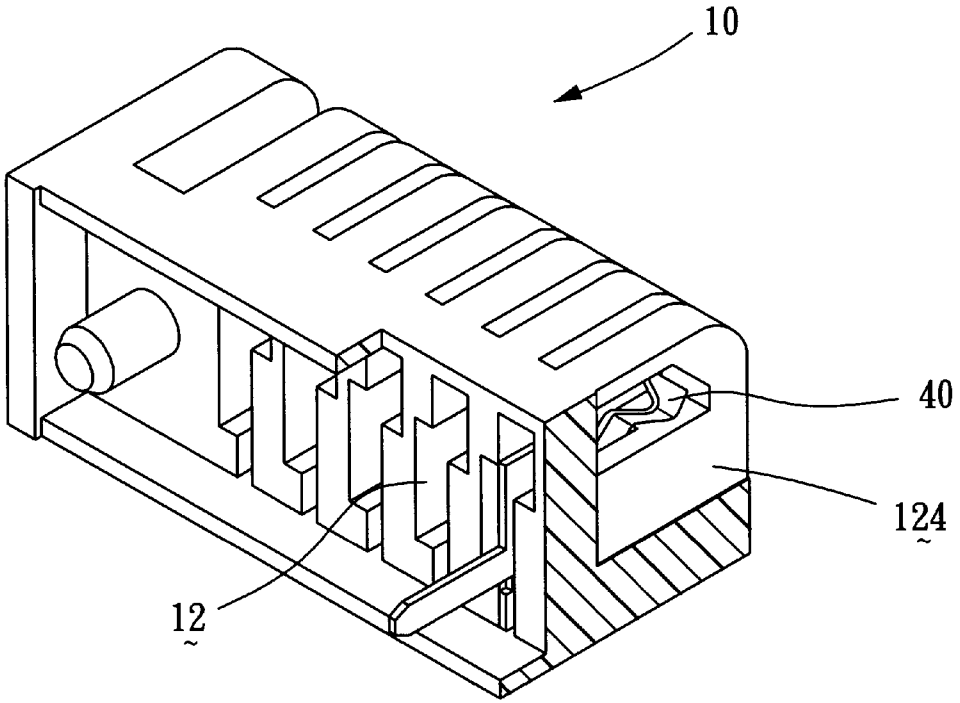
FIG. 4 is a view similar to FIG. 3 showing the engaging relationship between the electrical contact of the invention and the housing.
Figure 5:
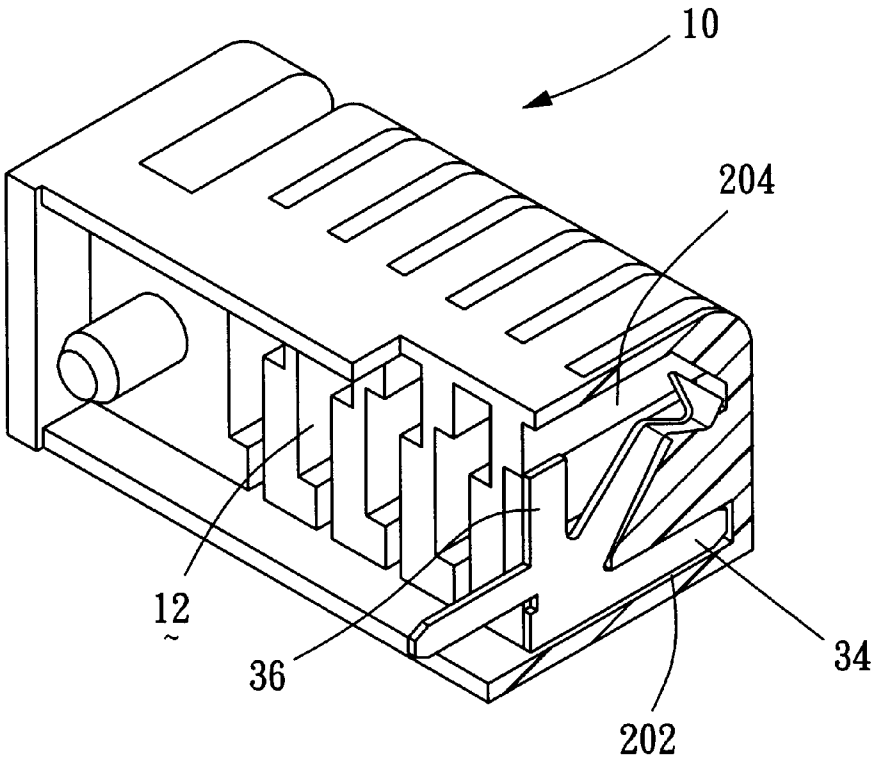
FIG. 5 is a view similar to FIG. 4 taken along a different cross-section.

As seen in FIG. 4, when the contact 30 is assembled in the housing 10, the angled end 40 is designed to project laterally outward from a plane of thickness of the contact 30 and to partially extend into the second cavity portion 124. The part of the angled end 40 extending into the second cavity portion 124 of the cavity 12 will then engage with a mating contact received in the second cavity portion 124. Different from the prior art which generally has the deflectable contact portion exposed to the mating cavity, in the invention only the angled end 40 is exposed to the mating second cavity portion 124 while most of the contact portion 32 is still hidden by the housing 10 and gets frictional support by the housing 10 during the initial period of mating, thus efficiently preventing withdrawal of the contact 30 from the housing 10 due to some incorrect or improper mating.

Figure 6:
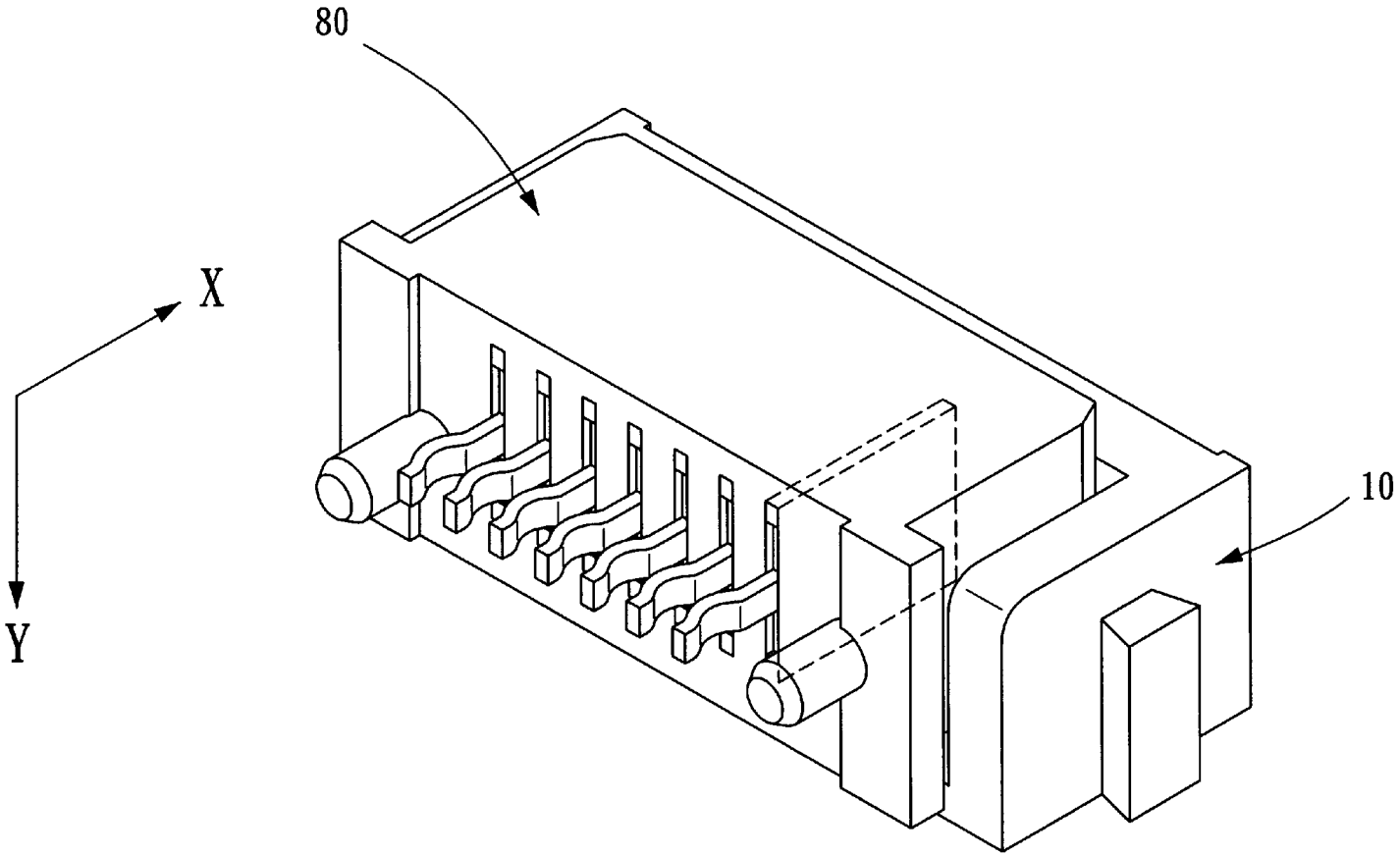
FIG. 6 shows the connector of the invention connected to a mating connector.

FIG. 6 shows the connector 10 of the invention connected with a mating connector 80. The mating connector 80 may be connected to the connector 10 along a direction as identified by reference character X, or along a direction as identified by reference character Y, or along any direction between direction X and Y.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector having an insulative housing, at least one contact receiving cavity defined in the housing, and an electrical contact received in a first cavity portion of each cavity, the contact having a contact portion extending diagonally forward into a second cavity portion of the cavity to engage with a mating contact received in the second cavity portion, wherein the improvement comprises:

the electrical contact having a first leg anchored in the first cavity portion of the housing and a substantially free second leg in flush with a wall of the first cavity portion;

the contact portion of the electrical contact having an angled end consisting of a narrow neck and a large sector, the large sector gradually enlarging toward a free end thereof; and the substantially free second leg of the electrical contact being spring biased against the wall of the first cavity portion only upon insertion of a mating contact into the second cavity portion.

* * * * *